US005974745A

United States Patent [19]

Barr

[11] Patent Number: 5,974,745

[45] Date of Patent: Nov. 2, 1999

[54] SELF-ALIGNING PREFABRICATED DOOR FRAME ASSEMBLY

[76] Inventor: Gerald L. Barr, 4403 N. Five Mile Rd., Boise, Id. 83713

[21] Appl. No.: 08/637,444

[22] Filed: Apr. 25, 1996

[51] Int. Cl.[6] ..... E06B 1/10

[52] U.S. Cl. ..... 52/212; 52/211; 52/210; 52/217; 52/717.01; 49/504; 49/505

[58] Field of Search ..... 52/210, 211, 212, 52/656.4, 657, 204.1, 217, 717.01; 49/504, 505

[56] References Cited

U.S. PATENT DOCUMENTS

| | | | |
|---|---|---|---|
| 2,835,933 | 5/1958 | Evans | 20/12 |
| 3,040,390 | 6/1962 | Carlton | 20/11 |
| 3,239,978 | 3/1966 | Parker | 52/211 |
| 3,250,049 | 5/1966 | Sklar | 52/211 |
| 3,338,008 | 8/1967 | Sklar | 52/211 |
| 3,429,076 | 2/1969 | Fortsch et al. | 52/211 X |
| 3,654,734 | 4/1972 | Lehman | 49/505 |
| 3,812,621 | 5/1974 | Ragland | 49/505 |
| 4,166,346 | 9/1979 | Barr | 52/211 |
| 4,395,855 | 8/1983 | Juker | 49/505 X |
| 4,713,922 | 12/1987 | Ingold | 49/505 X |
| 5,345,722 | 9/1994 | McKann | 49/505 |
| 5,365,708 | 11/1994 | Winston | 52/212 |
| 5,437,130 | 8/1995 | Raynak | 52/210 |

*Primary Examiner*—Beth Aubrey
*Attorney, Agent, or Firm*—Ken J. Pedersen; Barbara S. Pedersen

[57] ABSTRACT

The invention is a prefabricated door assembly for installation in a roughed-in door frame. The assembly includes a pair of vertically extending door jambs having interengaging casings and a header unit spanning the upper ends of the door jambs. The header unit includes a header board or jamb having interengaging horizontal casings. Both horizontal and vertical casings have pin nails protruding from their tongue portions which engage the jambs lightly during transport and installation prior to final nailing in place. The assembly also includes L-shaped brackets affixed to the upper outer corners which join and fasten the vertical and horizontal jambs together. The assembly may be packaged as a kit, which may include hinges, shims and/or shimming hardware.

13 Claims, 7 Drawing Sheets

SELF-ALIGNING PREFABRICATED DOOR FRAME ASSEMBLY

BACKGROUND OF THE INVENTION

1. Field of the Invention.

This invention relates, in general, to a prefabricated door frame kit designed for easy shipping, handling, storage, and installation. More specifically, this invention relates to prefabricated door frames constructed to self-align to fit out-of-plumb walls, warped doors, or varying wall thicknesses, while minimizing separation of joints.

2. Description of the Related Art.

Prefabricated door assemblies have been built in order to eliminate the need for skilled craftsmen to custom-build door frame and door systems at construction sites. Unitary construction of these prefabricated door assemblies has proved cumbersome, inefficient to ship, and difficult to install into imperfect roughed-in framing. Sklar (U.S. Pat. Nos. 3,250,049 and 3,338,008) and J. H. Parker (U.S. Pat. No. 3,239,978) disclose knock-down prefabricated door assemblies, which are relatively easy to transport to construction sites and which fit into openings that vary somewhat in size and shape. McKann (U.S. Pat. No. 5,345,722) discloses a plastic door frame, with first and second inside sections having a frictionally-engaging slot and tongue system for adjustment to varying wall thicknesses. Winston (U.S. Pat. No. 5,365,708) discloses jambs comprising two members, having L-shaped shoulders, which fit together to allow expansion of the jamb width.

G.L. Barr (U.S. Pat. No. 4,166,346) adds to a prefabricated door assembly refinements intended to maintain the tightness and integrity of the joints and of the connection of the door assembly to the door frame. Barr discloses tongue and groove connection of casings to jambs, and a connection between side and head jambs that provides an outward-biasing of the side jambs.

What is still needed is a prefabricated door frame assembly designed for easy installation that results in high quality appearance and tight-fitting joints, in spite of imperfections and irregularities in the rough-framing, jambs, or door.

SUMMARY OF THE INVENTION

It is the general object of the present invention to provide a prefabricated door assembly which is conveniently and inexpensively shipped and installed, which stays securely in place, and which retains the integrity of its connecting joints.

It is a particular object of the present invention to provide an expandable connection between the casings and jambs. This is preferably done by a tongue and groove connection of casings to the jambs and by the provision of a plurality of pins protruding from the tongues of the casings that are specially formed to engage the grooves provided in the jambs. These pins allow the casings to be adequately connected to the jambs for convenient shipping, storage, and installation. The connection is, however, loose enough to allow some movement of the casing during final positioning to conform to irregularities in the door opening and surrounding walls.

It is a further object of the present invention to include within the prefabricated door assembly two brackets which will connect the ends of the head jamb to the side jambs and maintain these connections throughout the useful life of the door assembly.

The invented door assembly may be put into a compact kit form, for efficient display and a self-contained product for do-it-your-selfers. The prefabricated door assembly and kit set forth in this invention may also contain hardware, for example, hinges or a means for providing and maintaining pressure between each jamb and its adjacent portion of door opening, that is, shims or shimming hardware.

DETAILED DESCRIPTION OF THE PREFERRED EMBODIMENTS

Figure 1:
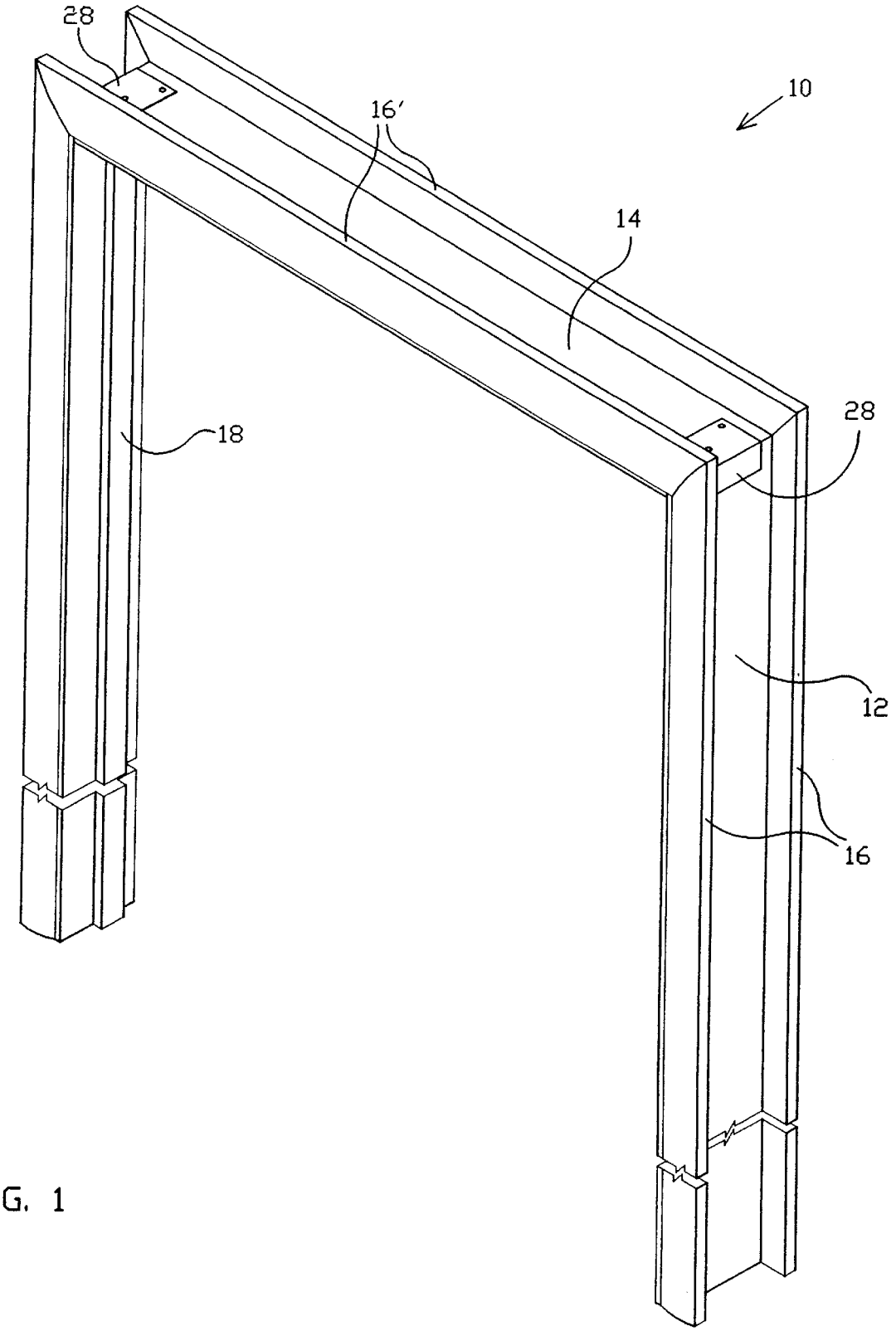
FIG. 1 is a perspective view of one embodiment of the door assembly invention, assembled.

It will be seen in FIG. 1 that the door assembly 10 is comprised of three basic parts—a pair of vertically upstanding side units and a horizontal header unit spanning the upper ends of the side units. The side units comprises side jambs, herein also called "vertical jambs" 12, which may be manufactured in any desirable length, for example, to fit the common 81½–82 inch roughed-in door openings. It is also contemplated that the foot ends of vertical jambs 12, side casings 16, and door stop 18 may be trimmed or cut to length at the construction site. The header unit comprises a horizontal or head jamb 14 and head casings 16'. Vertical jambs 12 and head jamb 14 are each of one-piece construction.

Figure 2:
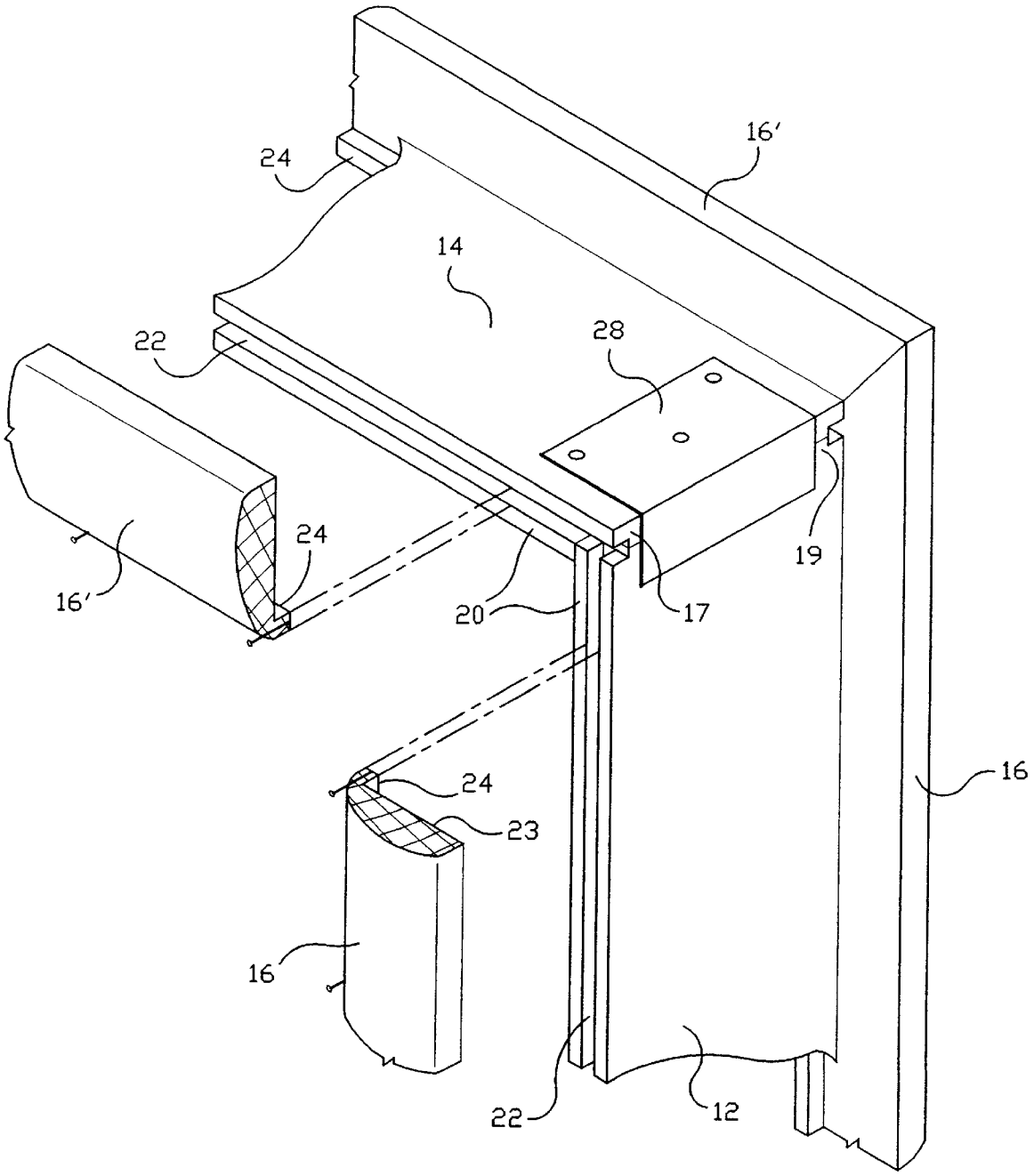
FIG. 2 is an exploded fragmentary perspective view of an upper corner of the door assembly invention of the embodiment of FIG. 1.

As shown in FIG. 2, the narrow, side edges 20, also called longitudinal edges, of each vertical jamb 12 and head jamb 14 contain longitudinal grooves 22 extending their entire length. These grooves 22 are sized to receive tongue 24 projecting transverse the body 23 of casing 16, 16'. Preferably, tongue 24 is slightly tapered to make its outer end slightly narrower than its connection to the casing body 23. Also, the walls of the groove 22 are slightly tapered so that the inner end of the groove is slightly narrower than the groove-opening. This tapering of tongue and groove allows for a good fit in spite of wood irregularities and swelling. Casing 16, 16' illustrates one of many possible alternative casing styles including the tongue 24 extending approximately perpendicularly from the body 23. The preferred casing 16, 16' is economical to manufacture and is simple and sturdy.

Head jamb 14 has a notch 15 cut on the underside of each end 17 transverse its length. Notch 15 is intended to rest upon the top end 19 of vertical jamb 12, and, by means of bracket 28, to engage the jamb top end 19.

Bracket 28 is a generally L-shaped member, with one leg attached to the head jamb 14 and the other leg extending down along the side of the top end 19 of the vertical jamb 12. Screws, nails, or other means secure the bracket 28 to the head jamb 14, while a friction fit of the vertical jamb 12 in between the bracket 28 and the notch 15 of the head jamb 14 connects the vertical jamb 12 to the head jamb 14. Bracket 28 is preferably constructed of plastic sturdy enough to sustain the desired 90° joint of vertical jamb 12 and head jamb 14 during the useful life of the door assembly, but is flexible enough to allow slight variations from the perfect 90° angle which are likely to occur in actual placement and installation. This flexible bracket 28, therefore, is an important means for providing a tight and close joint between the vertical jambs 12 and head jamb 14 while adjusting the joint to an imperfect roughed-in frame.

Figure 3A:
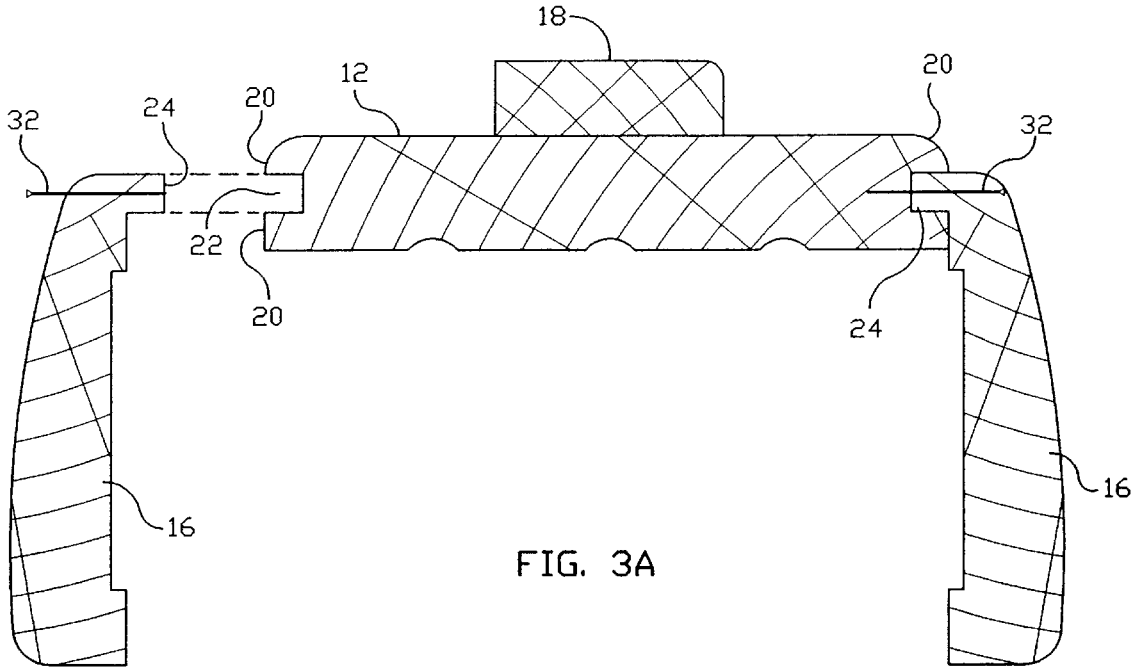
FIG. 3*a* is a cross-sectional end view of a jamb and casing of FIG. 2, with door stop attached to the jamb and pins included in the tongue and groove connection of the casings.
Figure 3B:
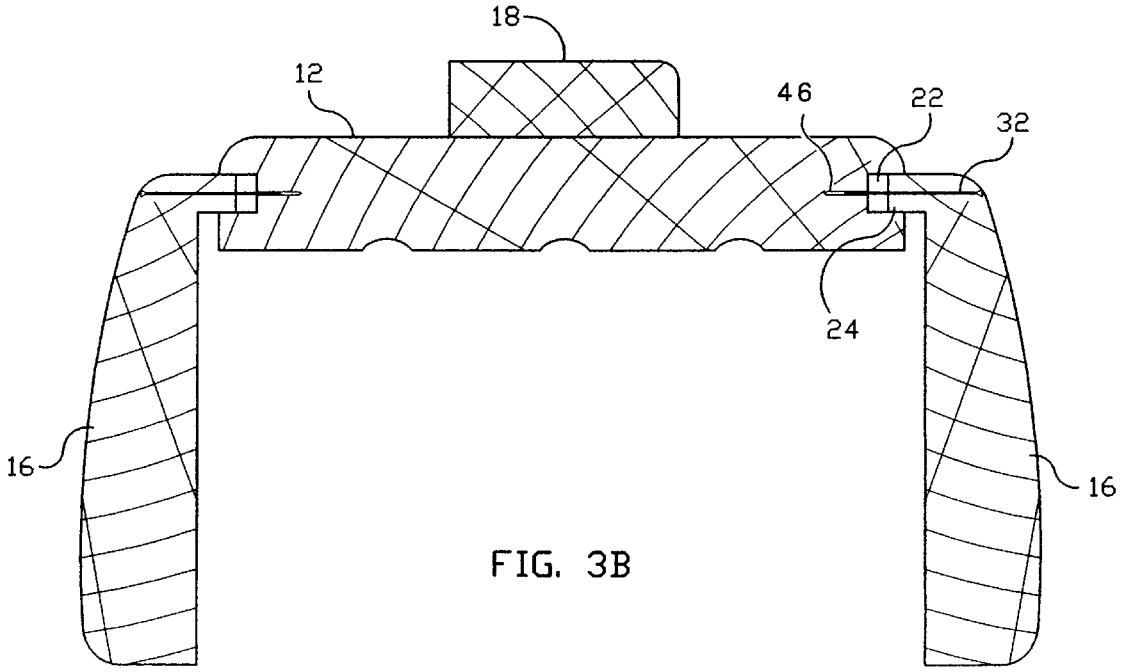
FIG. 3*b* is a cross-sectional end view of the embodiment of FIG. 3*a*, shown with the casing connections expanded.

FIGS. 3*a* and 3*b* show end cross-sectional views of a vertical jamb 12, casing 16, and attached door stop 18. Of special interest is pin 32 of approximately ¾ inch length embedded in the tongue 24 of the casing 16. This pin 32 engages the groove 22 of the jamb 12 securely enough to hold the casing in position, as shown in FIG. 3*a*, during storage, transport, and handling at the construction site. However, the pin 32 is loose enough to allow self-aligning of the casings 16 during installation in the roughed-in door opening during final installation.

By "self-aligning" is meant that, when the side assemblies or head assembly are installed in the roughed-in frame opening, the casings 16, 16' automatically move out from the jambs 12 in response to the force exerted on the casings by the irregularities of the roughed-in frame. That is, if the roughed-in framing is not perfectly in plumb or the framing and surrounding walls are not perfectly in plumb and a consistent thickness, the casings or part of the length of the casings will move out from the jamb to become distanced from the side edges 20 of the jamb 12, as shown in FIG. 3*b*. Preferably, the pin 32 does not come completely out of its hole in the groove 22 and preferably the casing tongue 24 does not come completely out of the groove 22, so that a connection between casing and jamb is maintained for strength until final nailing of the casing to the roughed-in frame and for a desirable appearance without gaps between casing and jamb. The preferred tongue 24 and groove 22 are ¼ " long, and the total expansion of the two casings is preferably up to about ⅜ ", that is, about 3/16 " on each side. Alternatively, smaller or larger tongue and grooves may be used, for example, ½ " tongue and groove and up to a total expansion of ⅞ ", that is, about 7/16 " on each side. In the same manner as here described for the vertical jamb 12 and vertical casings 16, pins 32 embedded in the tongue 24 of head casing 16' also allow self-alignment of the head casings 16' relative to the head jamb 14.

Thus, the pin 32 and tongue and groove system are a preferred embodiment of an expandable connection means for connecting casings to jambs, so that the casing may expand away from the jamb to selfalign during installation. This expandable connection makes installation easy even for a non-skilled installer, because the casings stay on the jambs and adjust to fit framing irregularities without any significant manipulation or adjustment by the installer.

Figure 4:
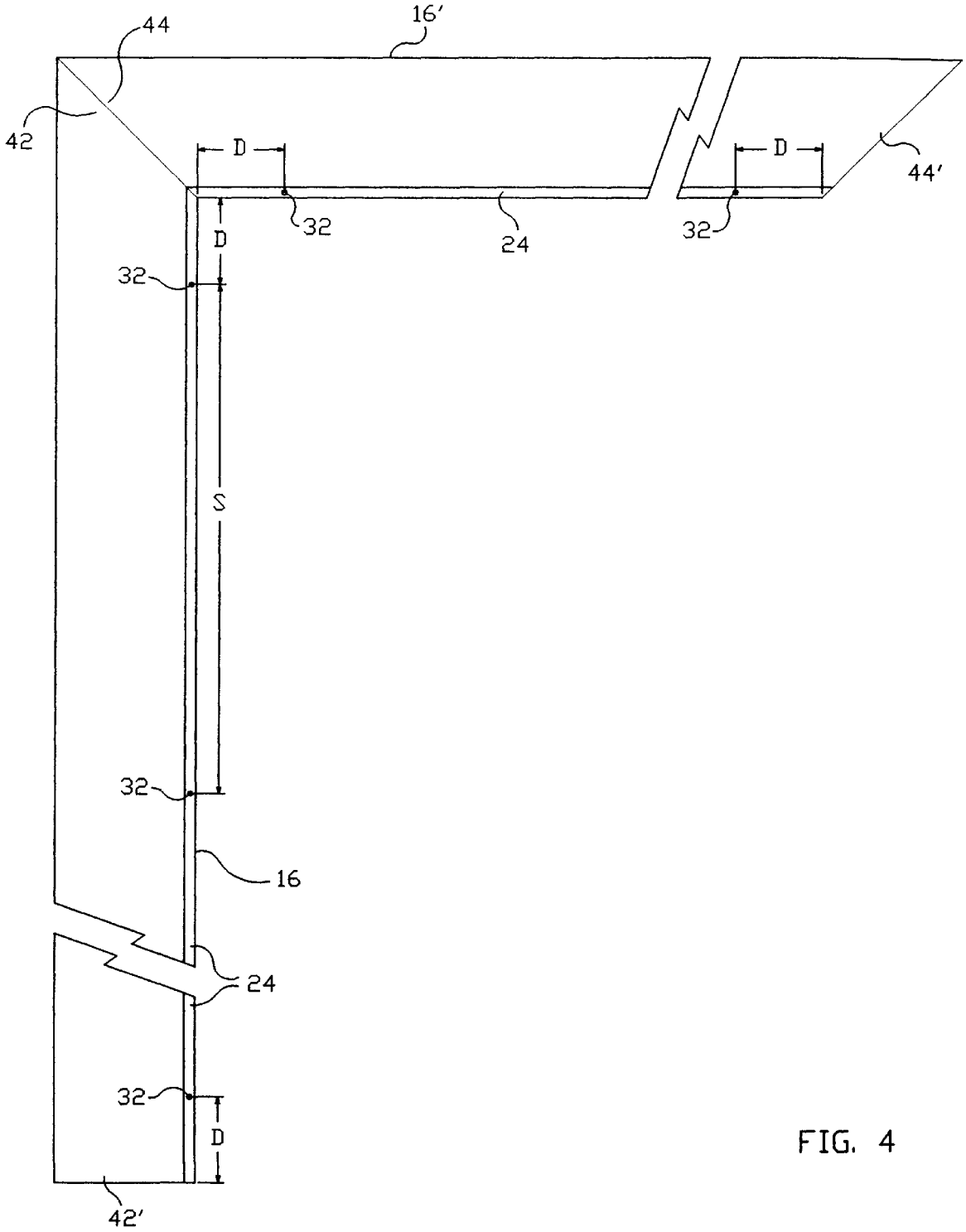
FIG. 4 is a view of the back of a side casing and head casing according to one embodiment of the door assembly invention, showing the pins protruding from the casing tongues.
Figure 5:
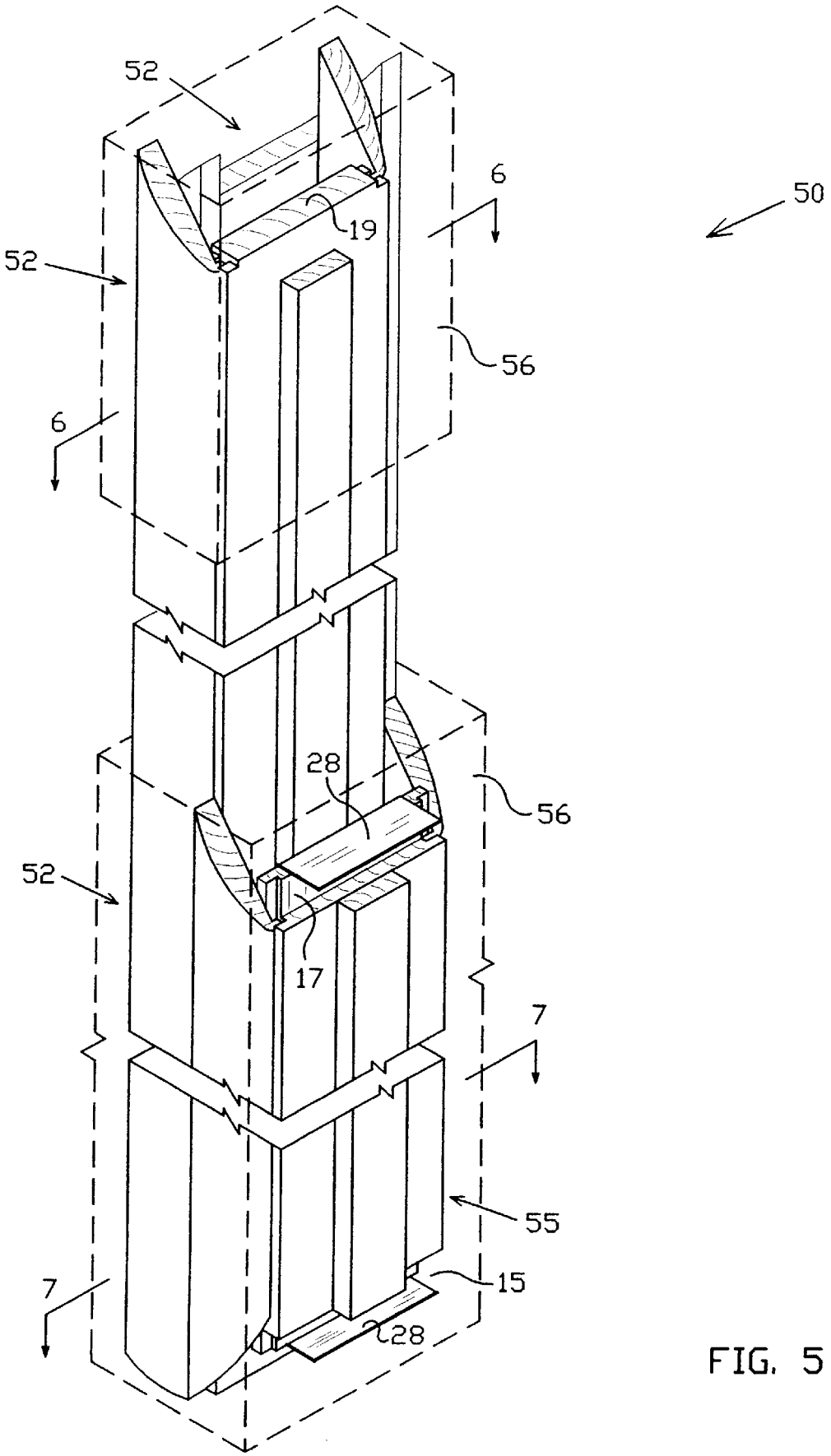
FIG. 5 is a perspective view of one embodiment of the door assembly kit according to the invention, including end-caps.

FIG. 4 shows the underside of side (vertical) and head (horizontal) casings 16, 16', with a plurality of pins 32 protruding from the tongue 24 of the casings 16, 16'. The side casing 16 is mitered on one end 42, and the head casing 16' is mitered on both ends 44, 44'. The mitered ends are those which, in final position, will be at one top corner of the door assembly 10.

A typical 83½ inch casing intended for vertical installation is preferably provided with 2–7 pins, and preferably 5 pins are used. The spacing (S) of the pins is preferably approximately even, preferably 17–21 inches, and no pin is positioned a distance (D) closer than 2 inches from either end 42, 42 of the casing 16.

A typical horizontal, head casing may be provided with 2–3 pins. Preferably, for a head casing up to about 2 feet, 4 inches in length, 2 pins are used. Preferably, for a head casing longer than 2 feet, 4 inches, 3 pins are used. The pins are spaced approximately 17–21 inches from each other, and no pin is positioned a distance (D) closer than 2 inches from either end 44, 44'.

Preferably, the pins 32 are pin nails, such as are used with air guns, which typically consist of an elongated shaft and only a very slight enlargement on one end of the shaft for a head. The preferred pin nail for pine or other soft wood is ¾ inches long, so that about ½ inch of the pin nail protrudes from the tongue 24 to enter the wood of the groove 22. Alternatively, a 1 inch pin nail may be used, except in hard woods, in which the 1 inch pin nail tends to hold in the wood of the groove too securely. The preferred pin nail gauge is 18. Larger diameter pin nails work less well, because they stick in the wood of the groove too tightly. Typically, the preferred pin nails are installed through the tongue 24 and into the groove 22, by use of an air gun, so that the act of installing the pin nail also creates the hole 46 in the groove in which the pin nail slides for expansion. Preferably, therefore, the holes in the grooves are not predrilled but created by installing the pin nails.

Thus, the expandable feature of the pin connection depends upon having pins of the proper size, length, and spacing, and the proper limitation on how close the pins can be to the end of the ends of the casings. The preferred pins is the pin nail described above, but alternatively, another pin could be used, even one that is inserted into the tongue from the underside of the tongue rather than completely through the tongue, as long as the pin protrudes the desired distance out from the underside of the tongue in the desired spacing and location. Also, other positions and spacing of pin nails or other expandable connection means may be used, as long as the casings are held on the jambs, but in an expandable manner. It has been found that conventional stapling of casings to jambs does not provide the selfaligning feature.

Figure 6:
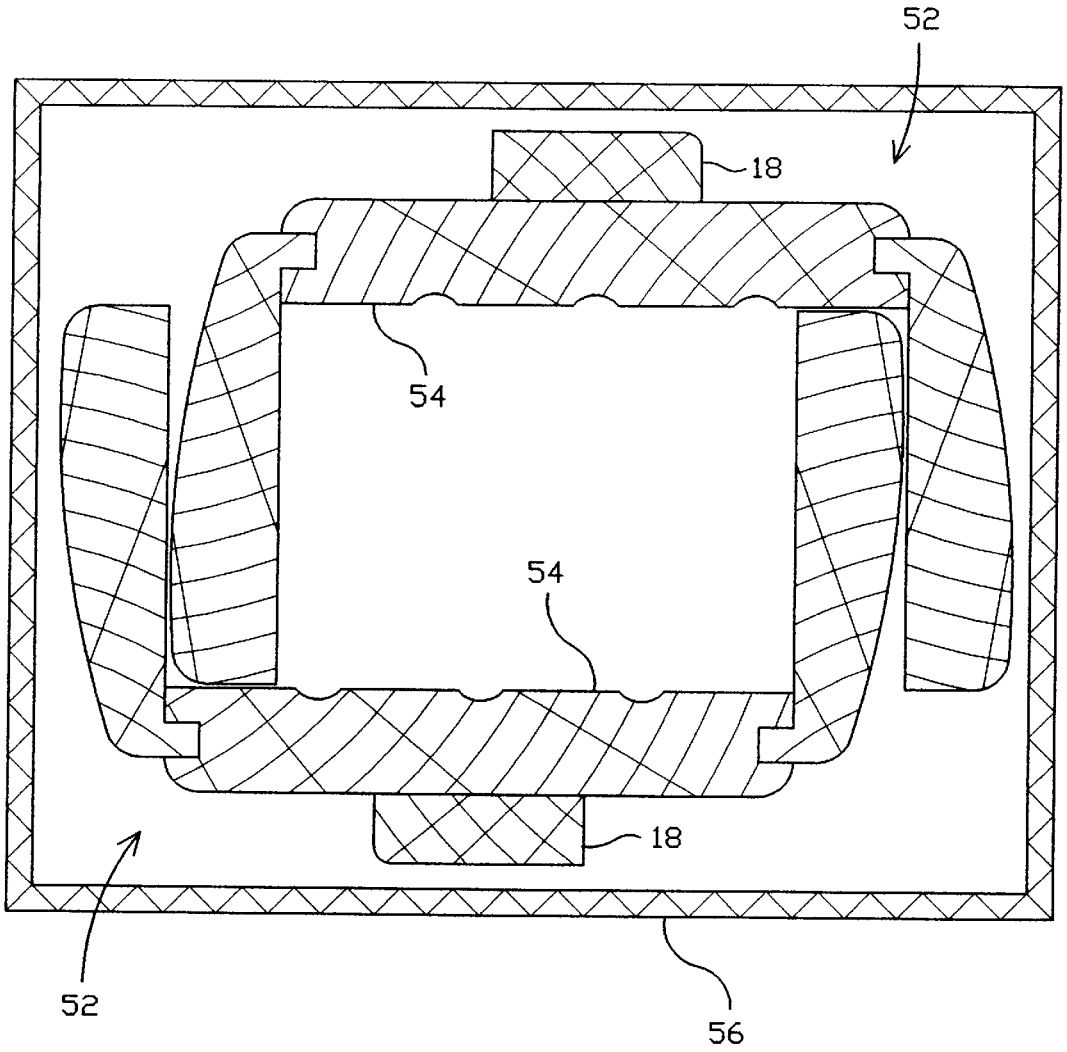
FIG. 6 is a cross-sectional view of the embodiment of FIG. 5, viewed along the lines 6—6.
Figure 7:
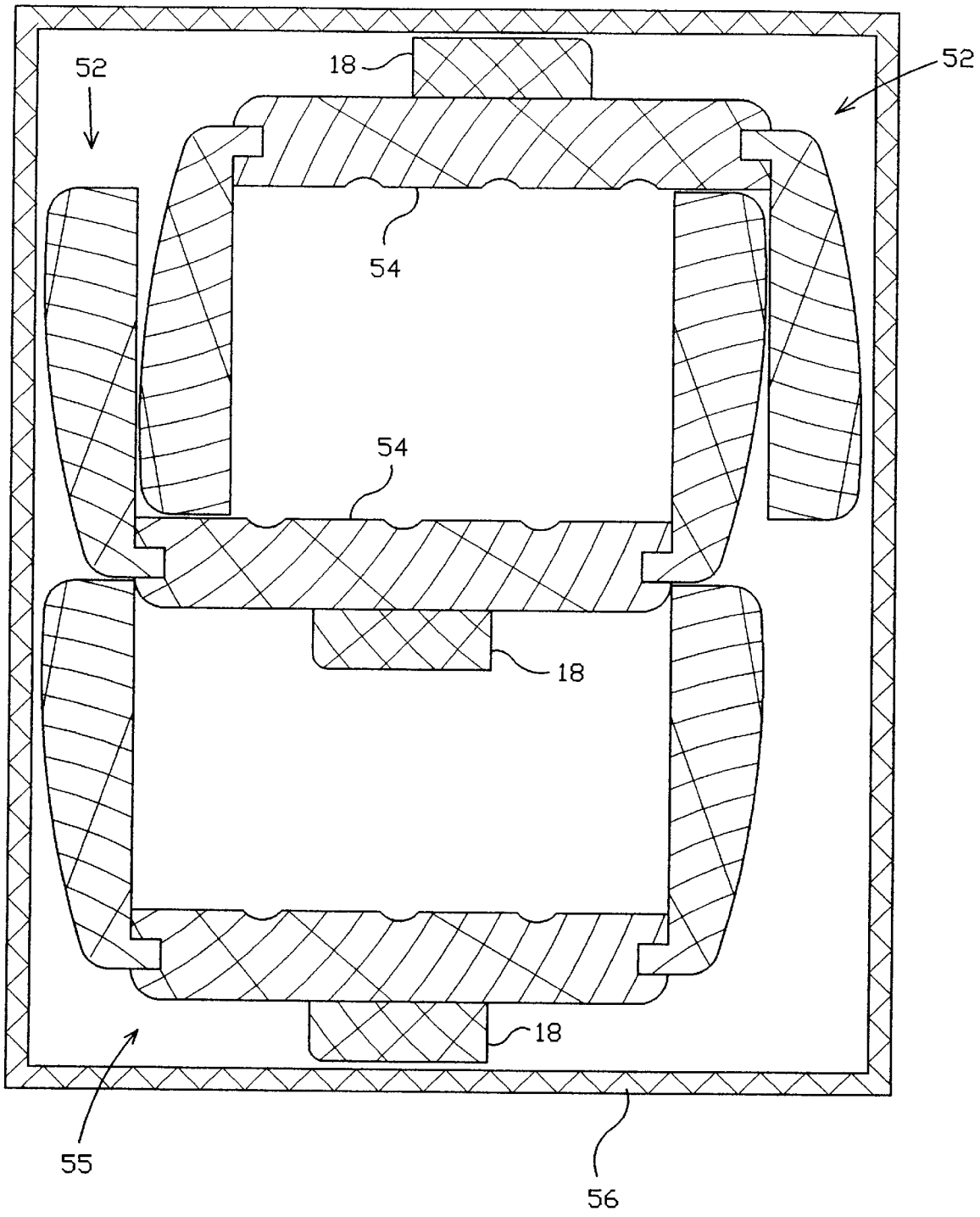
FIG. 7 is a cross-sectional view of the embodiment of FIG. 5, viewed along the lines 7—7.

The preferred door assembly may be packaged as a kit 50, for improving storage, handling, transport, marketing, and appearance on a store shelf. Do-it-your-selfers, especially, benefit from being able to buy a kit containing the invented door assembly, with connected and self-aligning casings. Preferably, the side jamb-casing assemblies 52 are nested, as shown in FIGS. 6 and 7, with the underside or inside 54 of the jamb and casings facing each other, and with the head jamb-casing assembly 55 along the side of the side jamb-casing assemblies 52 at the bottom of the kit 50. The jamb-casing assemblies 52, 55 then receive an end-cap 56 on each end, and may, optionally, be wrapped with transparent plastic wrap or shrink wrap. Thus, the jamb-casing assemblies 52, 55 are held together in a compact, manageable package. Optionally, hinges, shimming hardware, tools, instruction sheets or other items to aide the do-it-your-selfer may be included in the kit 50, to make it a self-contained, complete kit.

Installation of the invented door assembly 10 and use of the kit 50 may be done by the following methods. The head jamb-casing assembly 55 is installed at the top of the roughed-in frame opening The side jamb-casing assemblies 52 are then installed by inserting the top ends 19 of the side jambs 12 up into the brackets 28, while holding the assemblies 52 at a slight angle to the side studs, and then pivoting the assemblies 52 into place close to the side studs of the roughed-in frame. As the jamb-casing assemblies 55, 52 are pushed into their horizontal and vertical positions, respectively, the casings 16, 16' self-align, as described above, to fit the shape of the roughed-in frame. After the jamb-casing assemblies are in place and self-aligned, and shimming hardware adjusted as necessary, the installer may nail or screw the jambs or casings into permanent position.

Shimming hardware is optionally included in the kit 50 for use between jambs 12 and/or 14 and the stud lumber present in the wall's door opening in order to attain and maintain proper fit of the various component parts of the door assembly 10. Two sets of shimming hardware are preferably placed between the head jamb and the stud, with the adjustment members of the hardware being accessible through two holes bored through the head jamb 14. Shimming hardware is also preferably used with the side jamb-casing assemblies 52, for example, by positioning the shimming hardware between the side jambs 12 and the studs and accessing adjustment members through holes drilled through the hinge-side jamb 12 at the positions where the hinges are to be placed, and through the other side jamb at the position of the strike plate.

The framing system and the expandable connection system of this invention as recited in the description and claims is intended to also include window wrap applications.

The foregoing detailed description is intended to be an illustrative, not a restrictive, description of functional features of the preferred embodiment of the invention. The scope of the invention is indicated by the Claims following and any variations which fall within the meaning and range of equivalency of the Claims are therefore embraced therein.

I claim:

1. A door assembly for installation in a roughed-in door frame, the assembly comprising:

a. an elongated one-piece jamb having a longitudinal edge, the jamb longitudinal edge comprising a jamb groove;

b. an elongated casing having a longitudinal edge positioned near said longitudinal edge of the jamb, said casing longitudinal edge comprising a casing tongue projecting generally perpendicularly from the casing, said casing tongue being received by said jamb groove; and c. an expandable tongue-and-groove connection means comprising:

i) a pin extending from the casing tongue; and ii) a hole in the jamb groove slidably receiving the pin, said expandable connection means connecting the casing tongue to the jamb groove so that the casing is generally perpendicular to the jamb and so that the casing may be moved towards and away from the jamb by sliding the casing tongue relative to the groove.

2. The door assembly as set forth in claim 1, wherein the pin comprises a ¾-inch pin nail.

3. The door assembly as set forth in claim 1, wherein the casing longitudinal edge has opposing ends, and wherein the expandable connection means comprises a plurality of said pins spaced along the casing longitudinal edge, wherein none of said pins is less than 2 inches from either of said ends.

4. The door assembly as set forth in claim 3, wherein said pins are spaced 17–21 inches apart along the casing longitudinal edge.

5. The door assembly as set forth in claim 1, wherein the casing tongue has opposing ends, and wherein the expandable connection means comprises a plurality of said pins spaced along the casing tongue, wherein none of said pins is less than 2 inches from either of said ends.

6. The door assembly as set forth in claim 5, wherein said pins are spaced 17–21 inches apart along the casing tongue.

7. The door assembly as set forth in claim 1, further comprising:

a. a second jamb generally perpendicular to the first said elongated jamb, wherein the first and second jambs have ends contacting each other to form a corner joint; and b. a flexible connection means for connecting the said ends of the first and second jambs so that the joint may flex to place the said jambs at greater or less than 90°.

8. The door assembly as set forth in claim 7, wherein the flexible connection means comprises a flexible, L-shaped bracket.

9. A prefabricated door assembly kit comprising:

a. two side assemblies, each side assembly comprising:

i. a one-piece side jamb having two opposing longitudinal edges, the jamb longitudinal edges each comprising a jamb groove;

ii. two side casings, each having a longitudinal edge extending along and contacting one of the two opposing longitudinal edges of said side jamb, each casing longitudinal edge comprising a casing tongue projecting generally perpendicularly from the casing and said casing for tongue being received in said jamb groove; and iii. an expandable tongue-and-groove connection means connecting the longitudinal edges of the side casings to the two opposing longitudinal edges of the side jamb, so that the side casings are generally perpendicular to the side jamb and so that the side casing longitudinal edges may be moved towards and away from the side jamb longitudinal edges;

b. a head assembly comprising:

i. a head jamb having two opposing longitudinal edges, the head jamb longitudinal edges each comprising a head jamb groove;

ii. two head casings, each having a longitudinal edge extending along and contacting one of the two opposing longitudinal edges of said head jamb, each head casing longitudinal edge comprising a head casing tongue projecting generally perpendicularly from the casing and said head casing tongue for being received in said head jamb groove; and iii. an expandable connection means connecting the longitudinal edges of the head casings to the two opposing longitudinal edges of the head jamb, so that the head casings are generally perpendicular to the head jamb and so that the head casing longitudinal edges may be moved towards and away from the head jamb longitudinal edges;

c. wherein the two side assemblies and the said head assembly are nested together and the kit further comprises a wrapping means for at least partially surrounding said side and head assemblies; and d. wherein the expandable connection means of the side assemblies and of the head assembly comprise:

i. pins extending from the side casing tongues and head casing tongues; and ii. holes in the side jamb grooves and head jamb grooves slidably receiving the pins.

10. The door assembly kit as set forth in claim 9, wherein the side casing and head casing longitudinal edges each have opposing ends, and wherein the pins are spaced along the casing longitudinal edges and wherein none of said pins is less than 2 inches from the said ends of the casing longitudinal edges.

11. The door assembly kit as set forth in claim 9, further comprising two flexible, L-shaped brackets attached to said head jamb for connecting the head jamb to said side jambs.

12. A method of manufacturing a door assembly for installation in a roughed-in door frame, the method of manufacture comprising, expandably connecting a longitudinal edge of a one-piece jamb to a longitudinal edge of a casing prior to installation in a roughed-in door frame by providing a plurality of holes in a groove in the jamb longitudinal edge, and positioning a plurality of pins extending from a tongue projecting generally perpendicularly from the casing longitudinal edge so that the pins are slidably received in said holes in the groove in the jamb, so that the casing and jamb can be moved as a single unit and so that the casing can move away from and towards the jamb during installation to adjust to variations in the roughed-in door frame.

13. A method of manufacturing a door assembly as set forth in claim 12, wherein the jamb longitudinal edge comprises a longitudinal groove and the casing longitudinal edge comprises a longitudinal tongue, and wherein the step of expandably connecting the jamb to the casing comprises providing a plurality of holes in the jamb groove, and positioning a plurality of pins extending from the casing tongue so that the pins are slidably received in the said holes.

* * * * *